United States Patent [19]

Nishimura

[11] 4,235,207

[45] Nov. 25, 1980

[54] INTERNAL COMBUSTION ENGINE

[75] Inventor: Hiroyuki Nishimura, Kounosu, Japan

[73] Assignee: Honda Giken Kogyo Kabushiki Kaisha, Tokyo, Japan

[21] Appl. No.: 9,370

[22] Filed: Feb. 5, 1979

[30] Foreign Application Priority Data

Mar. 6, 1978 [JP] Japan ..... 53-24433

[51] Int. Cl.[3] ..... F02M 25/06; F02B 75/10

[52] U.S. Cl. ..... 123/568; 123/586; 60/304; 60/306

[58] Field of Search ..... 123/119 A, 124 R; 60/304, 305, 306

[56] References Cited

U.S. PATENT DOCUMENTS

| | | | |
|---|---|---|---|
| 3,739,797 | 6/1973 | Caldwell | 123/119 A |
| 3,779,222 | 12/1979 | Lorenz | 123/119 A |
| 3,818,880 | 6/1974 | Dawson et al. | 123/119 A |
| 3,884,200 | 5/1975 | Caldwell | 123/119 A |
| 3,915,136 | 10/1975 | Caldwell | 123/119 A |
| 3,970,061 | 7/1976 | Caldwell | 123/119 A |
| 4,033,308 | 7/1977 | Hayashi et al. | 123/119 A |

FOREIGN PATENT DOCUMENTS

| | | | |
|---|---|---|---|
| 1486093 | 9/1977 | United Kingdom | 123/119 A |
| 1486651 | 9/1977 | United Kingdom | 123/119 A |

*Primary Examiner*—Wendell E. Burns
*Attorney, Agent, or Firm*—Lyon & Lyon

[57] ABSTRACT

Apparatus for controlling introduction of gas into a passage of an internal combustion engine employs a first control valve in a gas introduction passageway, a second control valve in an air conduit connecting the intake passage to atmosphere, and a regulating valve responsive to vacuum intensity in the intake passage. The regulating valve actuates vacuum responsive actuators for the control valves. This system is used for recirculating exhaust gases into the intake passage, for introducing supplementary atmospheric air into the intake passage to modifying the air-fuel ratio in accordance with atmospheric pressure reduction at high altitudes, and for controlling the introduction of atmospheric air into the exhaust passage upstream from a catalytic converter or reactor.

15 Claims, 3 Drawing Figures

INTERNAL COMBUSTION ENGINE

This invention relates to internal combustion engines and is particularly directed to vacuum control apparatus for regulating the introduction of a gas into the intake passage or exhaust passage of the engine.

This invention finds particular usefulness in controlling exhaust gas recirculation, modifying the air-fuel ratio in accordance with reduction in atmospheric pressure at high altutides and controlling introduction of atmospheric air into the exhaust pipe upstream from a catalytic converter or reactor.

In conventional systems of this general type, a control member of the vacuum response type is employed, which is controlled either by a single vacuum or a plurality of composite vacuums of the intake system, or by feedback from the exhaust system. It has been found that direct vacuum control makes it difficult to satisfy performance requirements. When feedback from the exhaust system is employed for control, difficulties arising from carbon deposits, corrosion, heat resistance, vibration resistance, result in a low level of durability.

It is the purpose of this invention to improve on such prior art systems and, more specifically, the object is to provide a control system which operates in proportion to the engine load to control introduction of a gas into the intake passage or the exhaust passage of the engine.

Other and more detailed objects and advantages will appear hereinafter.

Figure 1:
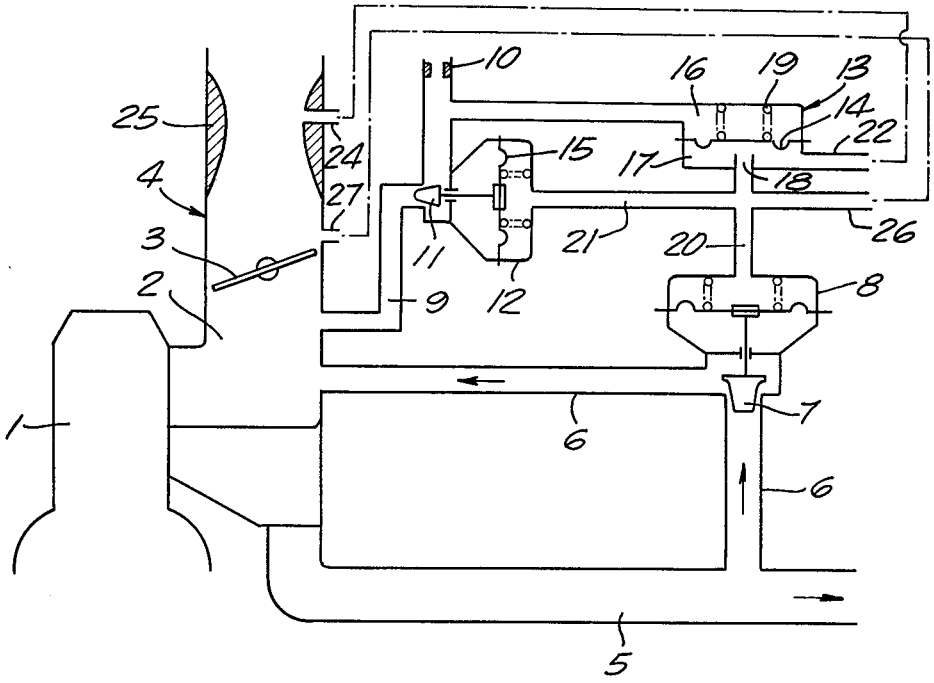
FIG. 1 is a side view of a preferred embodiment of this invention, shown in diagrammatic form.

Referring to the drawings, the preferred form of the invention shown in FIG. 1 shows an exhaust gas recirculating system. An internal combustion engine generally designated 1 has an intake passage 2 for an air-fuel mixture. A throttle valve 3 is positioned in this passage 2 downstream from the carburetor 4.

The engine is also provided with an exhaust passage 5 for carrying exhaust gases away from the engine. A passageway 6 connects the exhaust passage 5 to the intake passage 2. A first control valve 7 controls the flow of exhaust gases from the exhaust passage 5 through the passageway 6 and into the intake passage 2. This first control valve 7 has a vacuum responsive actuator 8.

An air conduit 9 connects the intake passage 2 with the atmosphere by way of the orifice 10. A second control valve 11 is positioned in the air conduit 9 to control flow of atmospheric air into the intake passage 2. This second control valve is provided with a vacuum responsive actuator 12.

A regulating valve 13 is responsive, by means of vacuum actuator such as a diaphragm 14, to both of vacuum intensities in the air conduit 9 between the second control valve 11 and the orifice 10 and in a first vacuum outlet 24 in a venturi portion 25 of the carburetor 4. This vacuum actuator has a diaphragm 14 which separates a first chamber 16 from a second chamber 17. The first chamber 16 communicates with the air conduit 9 and the second chamber 17 communicates with the first vacuum outlet 24. A valve port 18 opens into the second chamber 17 and it is closed by contact with the center portion of the diaphragm 14. The valve port 18 is controlled to be closed and opened to the second chamber 17 in accordance with pressure difference of both vacuum intensities in the first chamber 16 and the second chamber 17. Also a supplemental spring 19 may be provided to adjust said pressure difference as occasion demands. The valve port 18 communicates with the vacuum responsive actuators 8 and 12 by way of tubes 20 and 21. The tube 22 connects the second chamber 17 to the first vacuum outlet 24 in the venturi portion 25 of the carburetor 4. The tube 26 connects the vacuum responsive actuators 8 and 12 to the second vacuum outlet 27 located in the intake passage 2 upstream from the throttle valve 3 when the throttle valve is closed.

In operation, the operating vacuum generated at the second vacuum outlet 27 in the intake passage 2 acts on the vacuum responsive actuators 8 and 12 to open the first and second control valves 7 and 11. Exhaust gases from the exhaust passage 5 are then circulated back to the intake passage 2. The vacuum intensity in the air conduit 9 between the second control valve 11 and the orifice 10 acts on the vacuum actuator 14 to cause the central portion of the diaphragm 14 to lift away from the valve port 18. Also the vacuum intensity in the first vacuum outlet 24 introduced into the second chamber 17 through the tube 22 acts on the diaphragm 14 to cause the diaphragm 14 to close the valve port 18. Thus, the action of the vacuum actuator 14 is regulated by means of both vacuum intensities in the air conduit 9 between the second control valve 11 and the orifice 10 and in the first vacuum outlet 24 in the venturi portion. When the vacuum intensity at the first vacuum outlet 24 increases, the regulating valve 13 closes and acts to raise the vacuum pressure in the vacuum responsive actuators 8 and 12, with the result that the rate of flow of exhaust gas circulation also increases.

Figure 2:
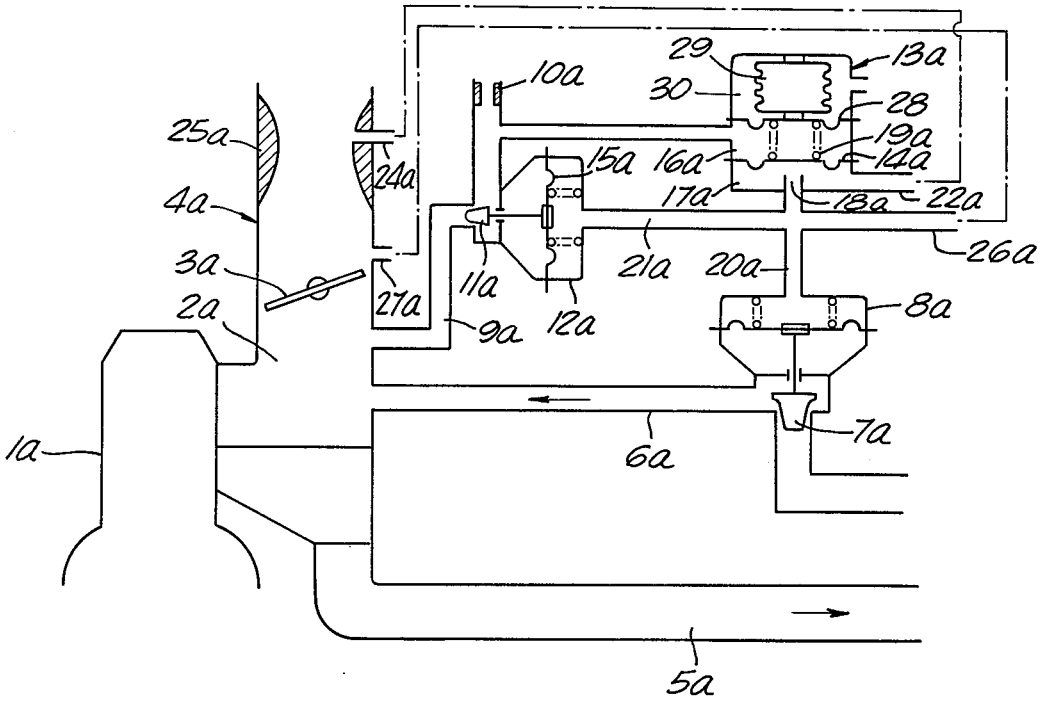
FIG. 2 is a view similar to FIG. 1 showing a modification in diagrammatic form.

The modified form of the invention shown in FIG. 2 comprises an atmospheric condition correction system. Atmospheric air is introduced into the intake passage **2*a* by means of the first control valve 7*a* positioned in the passageway 6*a*. The construction and arrangement of parts is the same as that described in connection with the first form of the invention shown in FIG. 1, with the following exceptions: (a) The spring 19*a* of the regulating valve 13*a* extends between the diaphragm 28 and the diaphragm 15*a*; (b) The diaphragm 15*a* is contacted by the sealed expansible bellows member 29 positioned within the atmospheric pressure correction chamber 30. The bellows member 29 acts to modify the force of the spring 19*a*** when there is a decrease in atmospheric pressure.

In the operation of the form of the invention shown in FIG. 2, the operating vacuum generated at the second vacuum outlet **27*a* causes the actuators 8*a* and 12*a* to move the control valves 7*a* and 11*a* toward open position so that atmospheric air is supplied through passageway 6*a* to the intake passage 2*a*. The operating vacuum is regulated by the regulating valve 13*a* modified by the atmospheric pressure correction system which includes the bellows member 29*a*. An increase of the vacuum intensity in the first vacuum outlet 24*a* and a decrease of atmospheric pressure act on the vacuum actuator 14*a* to cause the diaphragm 15*a* to close the valve port 18*a* and decreases the pressure in the actuators 8*a* and 12*a*, and as a result the flow of atmospheric air through the passageway 6*a*** increases.

Figure 3:
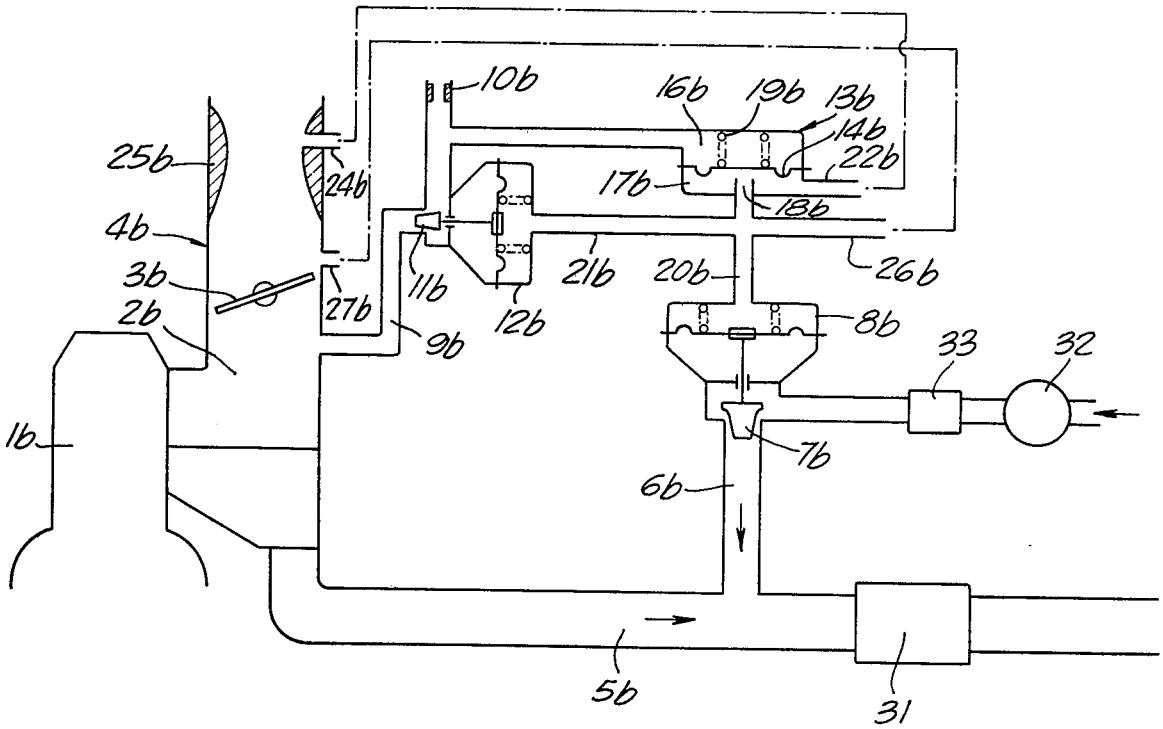
FIG. 3 is a view similar to FIG. 1 showing another modification in diagrammatic form.

The modified form of the invention shown in FIG. 3 comprises a catalytic system for exhaust purification of the engine 1. Atmospheric air is introduced into the exhaust passage 5*b* upstream from the catalyst on reactor 31. The construction and arrangement of parts is the same as that described in connection with the first form of the invention shown in FIG. 1, with the following exception: An air pump 32 pumps atmospheric air through the pressure regulator 33 into the exhaust passage 5*b* through the passageway 6*b*, controlled by the first control valve 7*b*.

In the operation of the form of the invention shown in FIG. 3, the operating vacuum generated at the second vacuum outlet 27*b* moves each control valve 7*b* and 11*b* toward open position so that atmospheric air is supplied through the passageway 6*b* to the exhaust passage 5*b* upstream from the catalyst or reactor 31. The operating vacuum is regulated by the regulating valve 13*b*. As a result, when the vacuum intensity in the first vacuum outlet 24*b* increases, the flow of atmospheric air into the exhaust passage 5*b* increases. Any vacuum generated in the intake system may be utilized as an operating vacuum.

From the foregoing description of these embodiments of this invention, it will be understood that operating vacuum from the intake passage acting on a control valve is regulated by a regulating valve placed in a passageway connecting the intake passage to atmosphere. The regulating valve responds in proportion to the engine load and therefore the control of introduction of gas is accomplished in a direct manner. Furthermore, the first control valve and the second control valve operate synchronously with each other so that by measuring the rate of flow through the orifice leading to atmosphere and selecting the flow characteristics of the second control valve on the basis thereof, various rates of the additional gas flow introduced into the engine can be established.

Having fully described my invention, it is to be understood that I am not to be limited to the details herein set forth but that my invention is of the full scope of the appended claims.

I claim:

1. In an internal combustion engine having an intake passage for delivering an air-fuel mixture into the engine, the intake passage having a venturi portion, the combination of: an exhaust passage for carrying exhaust gases from the engine, means including a passageway for introducing additional gas into one of said passages, a first control valve in said passageway, an air conduit connecting said intake passage to atmosphere, a second control valve in said air conduit, each of said control valves having a vacuum responsive actuator, and a regulating valve for controlling vacuum intensity in the actuator for each of said control valves, said regulating valve being responsive to differential vacuum pressure between vacuum pressure in said venturi portion and vacuum pressure in said air conduit.

2. The combination set forth in claim 1 in which means are provided for obtaining additional gas from said exhaust passage and delivering it through said first control valve to said intake passage.

3. The combination set forth in claim 1 in which means are provided for obtaining additional gas which constitutes atmospheric air and delivering it through said first control valve to one of said passages.

4. The combination set forth in claim 1 in which means are provided for obtaining additional gas which constitutes atmospheric air and delivering it through said first control valve to said intake passage.

5. The combination set forth in claim 1 in which means are provided for obtaining additional gas which constitutes atmospheric air and delivering it through said first control valve to said exhaust passage.

6. In an internal combustion engine having an intake passage for delivering an air-fuel mixture into the engine, the intake passage having a throttle valve and having a venturi portion, the combination of: an exhaust passage for carrying exhaust gases from the engine, means including a passageway connecting said exhaust passage to said intake passage downstream from said throttle valve for recirculating exhaust gases into said engine, a first control valve in said passageway, an air conduit connecting said intake passage to atmosphere, a second control valve in said air conduit, each of said control valves having a vacuum responsive actuator, and a regulating valve for controlling vacuum intensity in the actuator for each of said control valves, said regulating valve being responsive to differential vacuum pressure between vacuum pressure in said venturi portion and vacuum pressure in said air conduit.

7. In an internal combustion engine having an intake passage for delivering an air-fuel mixture into the engine, the intake passage having a throttle valve and a venturi portion, the combination of: an exhaust passage for carrying exhaust gases from the engine, means including a passageway for introducing atmospheric air into one of said passages, a first control valve in said passageway, an air conduit connecting said intake passage to atmosphere, a second control valve in said air conduit, each of said control valves having a vacuum responsive actuator, and a regulating valve for controlling vacuum intensity in the actuator for each of said control valves, said regulating valve being responsive to differential vacuum pressure between vacuum pressure in said venturi portion and vacuum pressure in said air conduit.

8. In an internal combustion engine, the combination of an intake passage for delivering an air-fuel mixture into the engine, a throttle valve in said intake passage, an exhaust passage for carrying exhaust gases from the engine, means including a passageway for introducing atmospheric air into said intake passage downstream from said throttle valve, a first control valve in said passageway, an air conduit connecting said intake passage downstream from said throttle valve to atmosphere, a second control valve in said air conduit, each of said control valves having a vacuum responsive actuator, and a regulating valve for controlling vacuum intensity in the actuator for each of said control valves, said regulating valve being responsive to differential vacuum pressure between vacuum pressure in said air conduit and vacuum pressure in said intake passage upstream from said throttle valve.

9. In an internal combustion engine, the combination of an intake passage for delivering an air-fuel mixture into the engine, a throttle valve in said intake passage, an exhaust passage for carrying exhaust gases from the engine, means including a passageway for introducing atmospheric air into said exhaust passage, a first control valve in said passageway, an air conduit connecting said intake passage downstream from said throttle valve to atmosphere, a second control valve in said air conduit, each of said control valves having a vacuum responsive actuator, and a regulating valve for controlling vacuum intensity in the actuator for each of said control valves, said regulating valve being responsive to differential vacuum pressure between vacuum pressure in said air conduit and vacuum pressure in said intake passage upstream from said throttle valve.

10. In an internal combustion engine having an intake passage for delivering an air-fuel mixture into the engine, the combination of: an exhaust passage for carrying exhaust gases from the engine, means including a passageway for introducing additional gas into one of said passages, a first control valve in said passageway, an air conduit connecting said intake passage to atmosphere, a second control valve in said air conduit, each of said control valves having a vacuum responsive actuator, and a regulating valve for controlling vacuum intensity in the actuator for each of said control valves, said regulating valve being responsive to vacuum pressure in said air conduit.

11. In an internal combustion engine having an intake passage for delivering an air-fuel mixture into the engine, the intake passage having a venturi portion and having a throttle valve, the combination of: an exhaust passage for carrying exhaust gases from the engine, means including a passageway for introducing additional gas into one of said passages, a first control valve in said passageway, an air conduit connecting said intake passage downstream from said throttle valve to atmosphere, a second control valve in said air conduit, each of said control valves having a vacuum responsive actuator, and a regulating valve having a vacuum responsive actuator for controlling vacuum intensity in the actuator for each of said control valves, said regulating valve being responsive to differential vacuum pressure between vacuum pressure in said venturi portion and vacuum pressure in said air conduit.

12. In an internal combustion engine having an intake passage for delivering an air-fuel mixture into the engine, the intake passage having a throttle valve, the combination of: an exhaust passage for carrying exhaust gases from the engine, means including a passageway connecting said exhaust passage to said intake passage downstream from said throttle valve for recirculating exhaust gases into said engine, a first control valve in said passageway, an air conduit connecting said intake passage downstream from said throttle valve to atmosphere, a second control valve in said air conduit, each of said control valves having a vacuum responsive actuator, and a regulating valve for controlling vacuum intensity in the actuator for each of said control valves, said regulating valve being responsive to vacuum pressure in said air conduit.

13. The combination set forth in claim 1 in which orifice means are provided in said air conduit between said second control valve and atmosphere, said regulating valve communicating with said air conduit at a location between said orifice means and said second control valve.

14. The combination set forth in claim 10 in which orifice means are provided in said air conduit between said second control valve and atmosphere, said regulating valve communicating with said air conduit at a location between said orifice means and said second control valve.

15. The combination set forth in claim 11 in which orifice means are provided in said air conduit between said second control valve and atmosphere, said regulating valve communicating with said air conduit at a location between said orifice means and said second control valve.

* * * * *